US006877521B2

(12) United States Patent
Webster et al.

(10) Patent No.: US 6,877,521 B2
(45) Date of Patent: Apr. 12, 2005

(54) TENT AND SUPPORT SYSTEM FOR SAME

(76) Inventors: Richard W. Webster, 16003 9th Ave. NE., Shoreline, WA (US) 98155; John T. Mann, 16003 9th Ave. NE., Shoreline, WA (US) 98155

( * ) Notice: Subject to any disclaimer, the term of this patent is extended or adjusted under 35 U.S.C. 154(b) by 112 days.

(21) Appl. No.: 10/219,963

(22) Filed: Aug. 15, 2002

(65) Prior Publication Data

US 2004/0031512 A1 Feb. 19, 2004

(51) Int. Cl.[7] ..... E04H 15/26
(52) U.S. Cl. ..... 135/99
(58) Field of Search ..... 135/115, 123, 135/900, 908, 99, 100, 87, 124, 128, 135, 120.1

(56) References Cited

U.S. PATENT DOCUMENTS

| | | | | |
|---|---|---|---|---|
| 172,882 A | | 2/1876 | Leavitt | 135/121 |
| 214,996 A | | 5/1879 | Doane | 135/100 |
| 1,409,316 A | | 3/1922 | Smith | 135/99 |
| 1,581,331 A | | 4/1926 | Smith | 135/125 |
| 2,084,778 A | | 6/1937 | Powers | 135/99 |
| 2,236,677 A | | 4/1941 | Eddy | 135/123 |
| 3,945,106 A | * | 3/1976 | Mayr et al. | 29/429 |
| 4,199,906 A | * | 4/1980 | Jasch et al. | 52/63 |
| 4,473,976 A | * | 10/1984 | Kuznetsov et al. | 52/223.3 |
| 4,736,553 A | * | 4/1988 | Geiger | 52/81.2 |
| 6,250,322 B1 | | 6/2001 | Porter | 135/98 |

FOREIGN PATENT DOCUMENTS

DE 2232399 * 1/1974

* cited by examiner

*Primary Examiner*—James O. Hansen
(74) *Attorney, Agent, or Firm*—Keith D. Gehr

(57) ABSTRACT

A tent is described that has a support system providing excellent head-room over the entire internal area. The tent is circular in cross section. A sidewall portion is joined at a defined transition to a generally conical roof section. Internally, there is a relatively narrow fabric tension shelf at the sidewall top transition. A top the tension shelf is a semi-flexible compression hoop. The top portion may have additional tension shelves and compression hoops, depending on the size of the tent. An internal center pole completes the support system. The pole, tension shelf, compression hoop, and fabric act together as an engineered unit to provide an exceptionally stable structure.

9 Claims, 3 Drawing Sheets

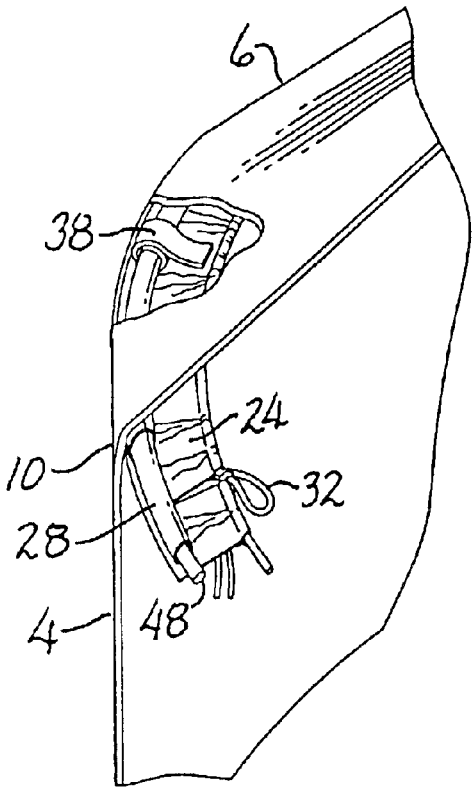
FIG. 4
FIG. 5
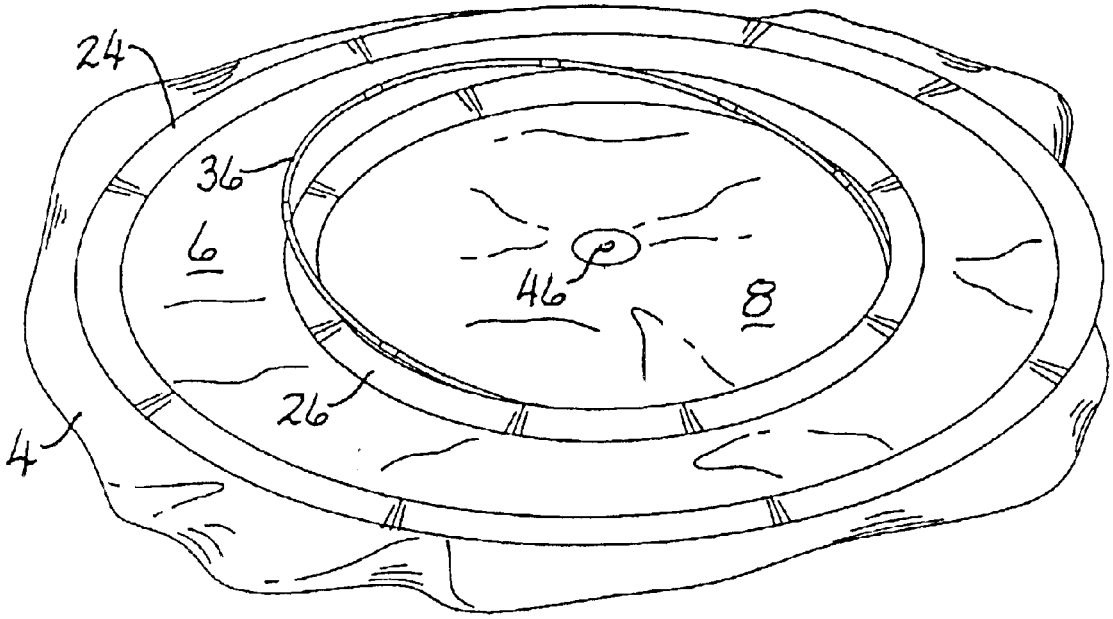

TENT AND SUPPORT SYSTEM FOR SAME

The present application is directed to a tent and its support system and to the method by which it is constructed.

BACKGROUND OF THE INVENTION

Tents have probably been used for shelter ever since animal skins became available for coverings. Many types and styles have been developed over the years from the compact mountain tents of backpackers to the huge enclosures used by circuses. Wall tents with straight relatively low sides and gable tops have been widely used for military and camping purposes. These have a ridgepole running the entire length supported by upright poles at each end. Similarly, pyramid-style tents have had wide military use. These are generally round with conical tops. They have a center pole and are stabilized by multiple guys on the outside. Pyramids are sized to hold from a few people up to a large number. Modified small wall tents or A-types are widely used by campers for light duty and may hold one to four people. These may have either internal or external support systems, the latter now being more common. Dome types with external support means are also popular for light camping since they offer a bit more usable floor space and headroom than the A-types.

One problem with most of the above tents, except for the very large ones, is restricted headroom. Even in the wall tents or pyramids, one can often stand erect only in the central location. This problem was partially solved by development of the so-called umbrella types. Originally these were supported by a center pole with radially extending spokes extending to the junction of the top and sidewall portions. Sidewalls were nearly vertical and the top was a low angle four-sided pyramid. Later, external supports were developed to eliminate the center pole. Some umbrellas are supplied with side rooms that require additional poles for support. The umbrellas are very popular for family camping since they are relatively easy to erect and have good headroom over most of the floor area.

One would think that tent development would have reached maturity many years ago but this is certainly not the case. A brief look at the patent literature and outdoor catalogs shows continuous development from early days to the present. One problem has remained constant—that of having a high ratio of headroom space to the total floor area. This is coupled with the need for ease and simplicity of erection along with minimum weight. The tent of the present invention serves those needs exceptionally well.

Among the prior known tents that are related to the present invention can be mentioned Doane, U.S. Pat. No. 214,996, which is an example of a large pyramidal tent with side walls. Eddy, in U.S. Pat. No. 2,236,677, shows a similar tent but one that has a peripheral frame supporting the juncture between the walls and top portions.

Recent U.S. Pat. No. 6,250,322 to Porter shows a circular umbrella-type having a conventional center pole with spokes connected to a peripheral roof ring located at the juncture between the top and side walls. The center pole is permanently anchored to the ground.

An early patent to Leavitt, U.S. Pat. No. 172,882 shows a tent that may be of circular, square, or oval configuration. This has a center pole and a rigid metal reinforcing ring at the periphery where the top and side walls are joined. The reinforcing ring may optionally be connected to the center pole by radial spokes. It is held to the roof/sidewall junction by twine or wire ties. A somewhat later patent to Smith, U.S. Pat. No. 1,409,316, shows a beach cabana in which the support is a center pole with a ring formed from a plurality of flexible sections at the top-sidewall juncture. This ring is also held in place by a series of internal tabs. Finally, U.S. Pat. No. 1,581,331 to Smith describes a larger tent of circular cross section using a center pole and a series of flexible jointed supporting rods located as a ring around the top-sidewall juncture. Once again, this ring is held in place by a plurality of supporting flaps or tabs which must be individually fastened.

The present invention is of the general type of construction as that shown in the last three patents noted above but represents a significant improvement in simplicity, stability, ease of erection, and compactness when stored.

SUMMARY OF THE INVENTION

The present invention is a tent having a novel support system that gives full headroom over the entire internal area and is easy and simple to erect. The tent will preferably be circular or essentially circular in cross section as seen in plan view. It may have an essentially vertical sidewall section when erected. This is joined at a well defined transition to a top section that preferably will be generally conical or have a conical portion atop one or more frustoconical sections. Alternatively, the top may be essentially flat although this is not preferred. Internally, at the transition between the sidewall and top portions, there is a circumferential, relatively narrow tension shelf The tension shelf may be a single or a superposed double ring of fabric. Located atop or within the tension shelf in the erected tent is a compression hoop bearing outwardly against the tent fabric. This shelf and hoop work as a unit to give support and stability to the tent without the need for an extensive external or internal pole system and without the need for a multiplicity of individual ties for the hoop. A center pole between the apex of the top portion and the lower surface upon which the tent is resting completes the structure. In larger tents the top portion may be constructed with two or even more vertices and two or more poles might be used. In some circumstances, e.g. when a convenient tree limb might be overhead for support, the center pole is not necessary.

One or more additional tension shelf/compression hoop configurations may be located above the one at the top-sidewall junction. These would typically be placed where there is a change of angle in the top portion, although it is not essential that they be so located nor is a change of angle in the top portion required.

The tent is preferably equipped with appropriate tabs for securing it to the ground or a tent platform and for attaching external guy lines for additional wind stability.

It is an object to provide a support system for a tent that is simple and gives exceptional stability even in high winds.

It is a further object to provide a tent that has headroom over the entire extent of the internal area.

It is another object to provide a tent using circumferential tension shelves and compression hoops for support and stability.

It is yet an object to provide a tent that may be readily and simply erected and taken down and which is extremely light in weight for the internal area covered.

It is also an object to provide a tent that may readily include windows or other openings.

It is still an object to provide a tent that may be easily and conveniently pitched on uneven terrain.

These and many other objects will become readily apparent upon reading the following detailed description taken in conjunction with the drawings.

BRIEF DESCRIPTION OF THE DRAWINGS

FIG. 4 is a cut away section seen from a somewhat elevated viewpoint of the circumferential tensioning system for the tent.

FIG. 5 is a depiction of the tent in an upside down position during initial insertion of one of the circumferential compression hoops.

DETAILED DESCRIPTION OF THE PREFERRED EMBODIMENTS

Figure 1:
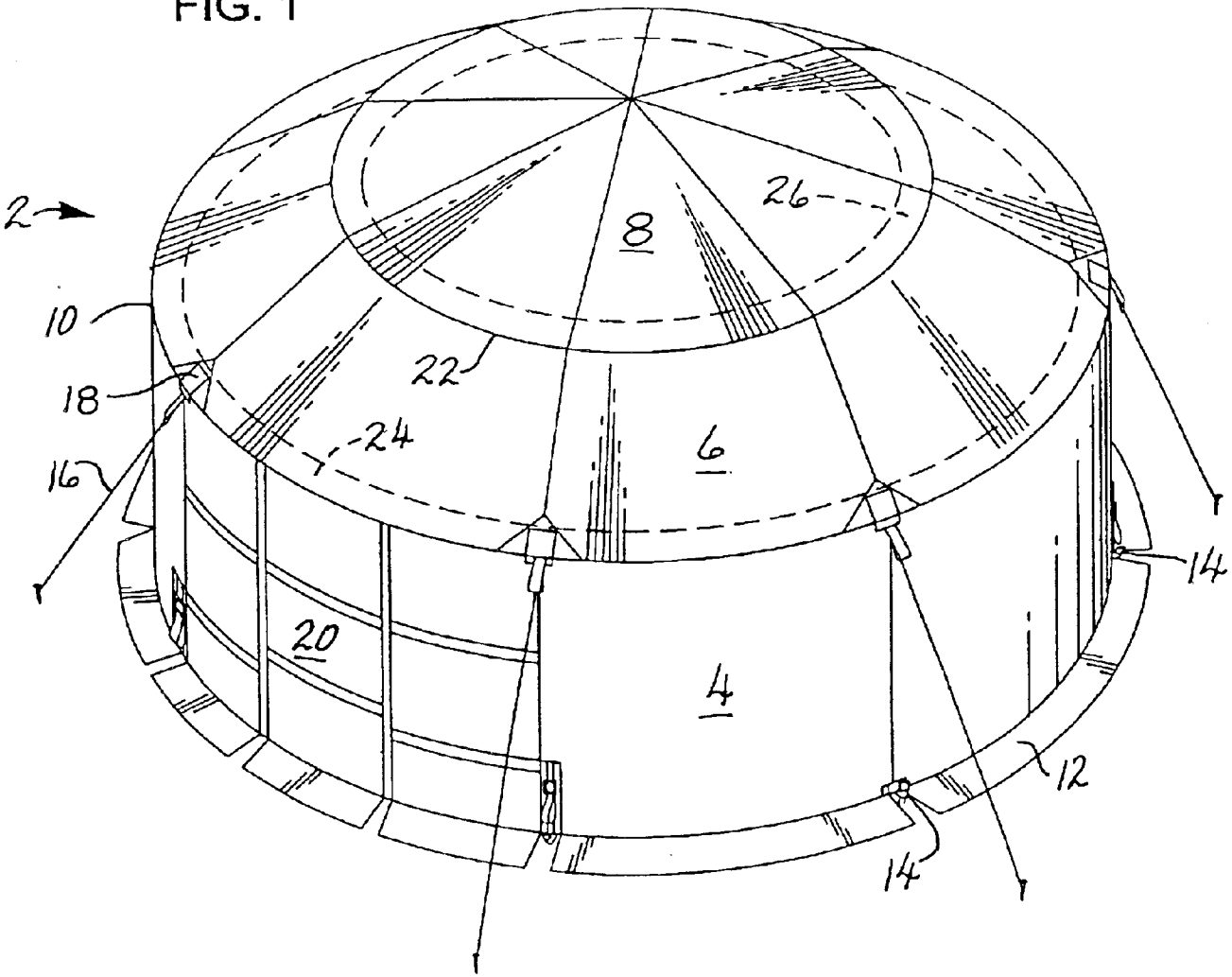
FIG. 1 is a perspective view seen from somewhat above of one version of the erected tent of the present invention.

In the description that follows, like numbers will be used for like elements in all of the figures. Referring now to the drawings, FIG. 1 shows one version of the present invention. A circular tent, generally seen at 2, has a sidewall section 4 and a top portion 6, 8. There is a clear transition 10 at the junction of the sidewall and top. The tent may optionally have a ground skirt 12 at the bottom of the sidewall. Stakes 14 are used to secure the lower edge of the sidewall to the ground. Similarly, optional guy lines 16 are secured to tie tabs 18 located around the outer edge of the transition between the sidewall and top. One or more door openings 20 allow access to the interior. These may be fastened with ties, Velcro strips, or zippers in a conventional manner.

In the version shown, tent 2 has a lower top portion 6 in the form of a truncated cone. Atop this is an upper conical portion 8 joined to the lower portion along transition zone 22. This construction is preferred for a larger tent. A smaller tent might simply have a single conical top section. For very large tents additional stacked truncated sections might be used. Additional central area support poles and vertices may also be used. While the tent can be made in the smaller sizes often used by back-packers, it will most often be made in sizes suitable for so-called family camping. This use demands greater space and comfort and the sidewall will typically be sufficiently high so that most or all of the area under the top will at least be high enough to permit standing erect. Many other uses are contemplated such as emergency shelters or other applications where tents have been used or would be satisfactory.

Inside the tent are tension shelves 24 located at the transition between the sidewall and top and 26 placed at the transition between then lower and upper portions of the top. These are key to support of the tent and their construction and purpose will now be explained.

Figure 2:
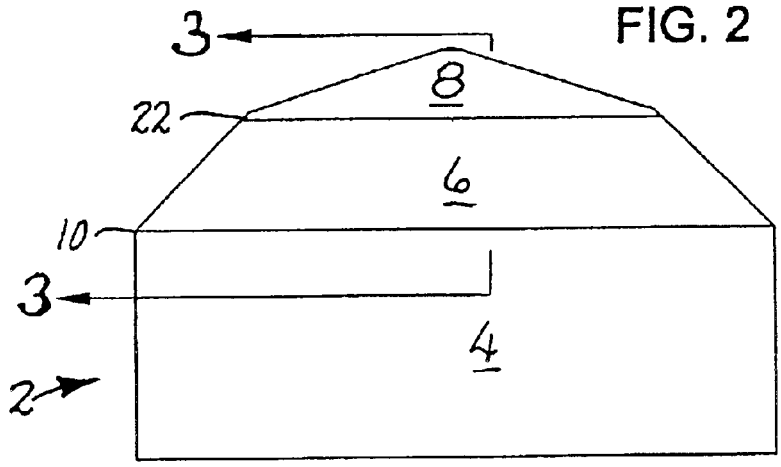
FIG. 2 is a side elevation in outline of the tent of FIG. 1.
Figure 3:
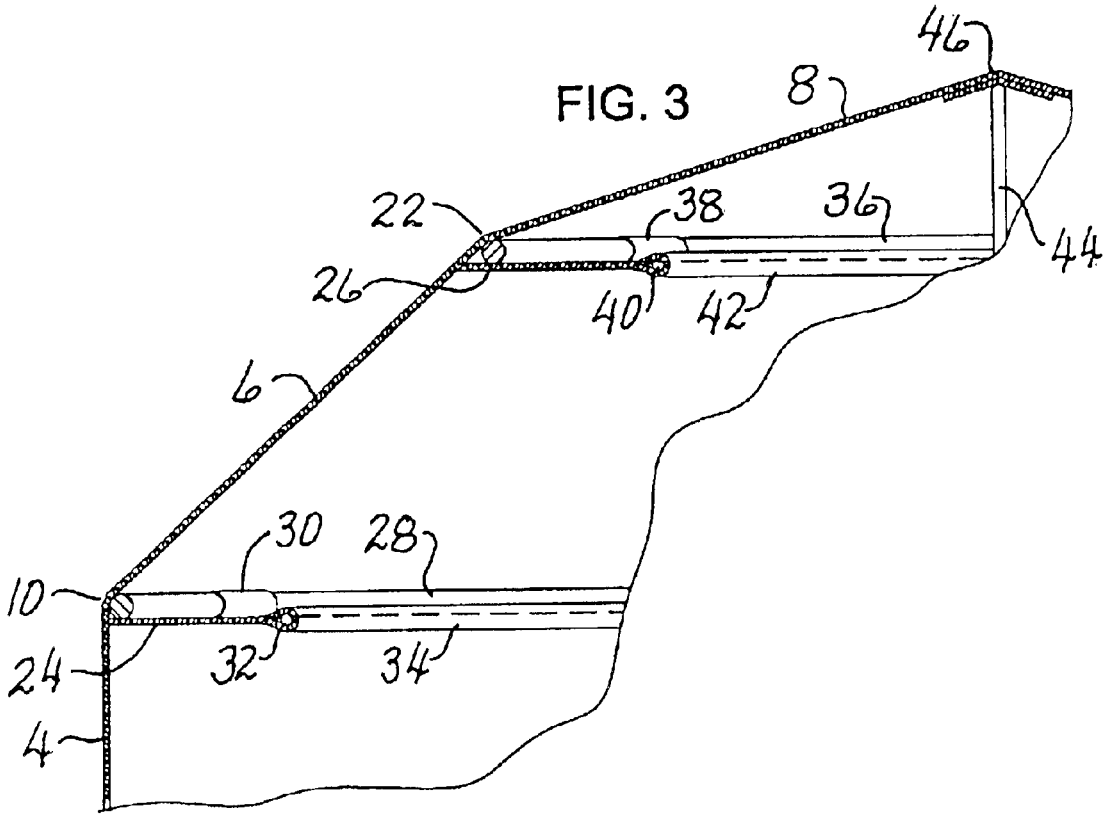
FIG. 3 is a section through line 3—3 of FIG. 2.

The tent is seen in profile in FIG. 2 and the construction of the tension shelves 24, 26 are seen in the cut away of FIG. 3. The tension shelves are relatively narrow; e.g., 8–15 cm wide, and are sewn or otherwise affixed to the tent fabric at the respective transition zones. Above each of the tension shelves is a compression hoop that may be constructed of interlocking shorter sections of standard semiflexible aluminum or fiberglass tent poles, or similar suitable materials. Where closely superposed or double tension shelves are used the compression hoop is placed between them. Compression hoop 28 is located above shelf 24. This may be temporarily held in place by optional ties or Velcro tabs 30 during erection of the tent. Preferably a drawstring 32 or similar tensioning device such as a length of elastic cord may be held in a fold or series of loops 34 on the outer edge of the tension shelf to draw it tight after erection. However, this is not essential. In similar manner, compression hoop 36 rests on shelf 26. This may also be retained during tent erection by one or more Velcro tabs or ties 38. Optional drawstring 40 is retained in the outer periphery of shelf 26, as within a fold 42. When fully erected the tent is supported by a center pole 44 sited between the reinforced apex 46 of top section 8 and a lower surface, normally the ground or a tent platform.

The construction of the tension shelves in an erected tent is seen in somewhat more detail in FIG. 4. Here it is seen that the sections of compression hoop 28 are held together by an internal elastic cord 48, as is common practice.

FIG. 5 illustrates the tent during its erection phase. The tent is first spread out on the ground upside down. Compression hoop 28 has already been inserted adjacent tension shelf 24 and compression hoop 36 is presently being inserted adjacent tension shelf 26. At some time after the hoops are inserted the drawstrings at the outer periphery of the tension shelves are tightened and tied. The draw cord, while not essential, helps to accommodate abberations the stretch and cut of the fabric. The tent is then inverted and center pole 44 inserted to erect the tent to its position of use. Edges around the perimeter may be staked down either before of after the tent is fully erected. If additional stability is desired; e.g., protection against high wind, guy lines 16 may be attached and staked down. Alternatively, the tent may be erected by staking down the perimeter, raising the center pole, and then inserting the compression hoops from within the tent. After insertion, the compression hoops bear outwardly against the periphery of the tent to assure that it will maintain its configuration in an extremely stable manner.

When secured at the base perimeter or with guy lines, the tension shelf, compression hoop or hoops, the external fabric, and the center pole work together to create a stable, wind-resistant structure. Upward tension on the external fabric balances compression forces downward on the center pole and inwardly on the compression hoop or hoops. Working as a unit, the structural elements create a tight wind-resistant shell. The tension forces on the fabric and tension shelf perfectly balance the compressive forces on the center pole and hoop. The tension shelf balances with the section of exterior fabric above the compression hoop to keep the fabric taut.

Lacking the tension shelf, the compression hoop would have to be of much heavier and more rigid construction to withstand the pressure from wind and fabric. While somewhat resembling an older center pole internal support umbrella-type tent, the tent of the present invention does not need the spreader bars attached to the center post or stays extending down from the apex. It has the significant advantage that it may have full unobstructed standing room over the entire internal area, a feature virtually unobtainable in most other tent constructions. The present tent is different from internal or external frame umbrella-types in that the fabric and support system are interdependent—they function as a unit. In umbrella tents the fabric simply drapes over a framework and is not integral with the support system.

In still conditions, the tension forces are evenly distributed around the tension shelf. However, when lateral wind forces are applied the forces in the tension shelves concentrate parallel to the applied force. The structure may then assume a slightly oval shape although this is resisted by the tension shelf and compression hoop.

Depending on its size, the tent may be readily erected by one or two people. In the larger sizes there is adequate room for amenities such as a wood stove, chairs, tables, etc., again made possible by the unobstructed headroom. The ratio of weight to useable area can be very low because of the simplicity of the support system based on the tension shelves.

In addition to use as a shelter for humans, the tent may have a transparent or translucent fabric for service as a greenhouse.

It will be evident to the reader that some variations in the construction may be possible that have not been described herein. As one example, tension shelves may be used in pairs to sandwich the compression hoop. This prevents any tendency to upward movement or downward slippage and provides additional strength in extreme conditions. The tent may be constructed with windows or skylights. It may additionally have an integral or separate floor. It is the intention of the inventors that these and many other possible variations should be included within the scope of the invention if encompassed within the following claims.

What is claimed is:

1. A tent which comprises fabric sidewall and top portions, the tent being generally circular in cross section as viewed from above and having a clearly defined transition between the sidewall and top portions, the tent having a relatively narrow circumferential tension shelf sewn at the side-wall-top transition location;

a circumferential compression hoop located above the tension shelf in the erected tent and bearing outwardly against the tent at the transition location so as to maintain the cross-sectional shape and stabilize the tent when erected; and a support acting against the top portion to maintain the tent erect, whereby the tension forces on the fabric and tension shelf balance the compressive forces on the support and compression hoop to maintain the fabric taut and the tent stable and wind resistant.

2. The tent of claim 1 in which the support is at least one interior up-right pole acting between a lower surface and the top portion.

3. The tent of claim 1 in which the top portion is generally conical in form.

4. The tent of claim 1 in which the top portion above the transition between the sidewall and top portion is divided into a plurality superposed defined sections, a transition zone being located between each section, a tension shelf and compression hoop being located at the transition between each section.

5. The tent of claim 4 in which the top portion has a lower section adjoining the sidewall which is generally in the form of a truncated cone and an upper section which is generally conical in form.

6. The tent of claim 4 in which the tension shelves each have a tightening means at their edges.

7. The tent of claim 1 in which the tension shelf has a tightening means.

8. The tent of claim 7 in which the tightening means is a drawstring located at the edge of the tension shelf.

9. The tent of claim 1 having at least one entry door in the sidewall portion.

* * * * *

UNITED STATES PATENT AND TRADEMARK OFFICE

CERTIFICATE OF CORRECTION

PATENT NO. : 6,877,521 B2
DATED : April 12, 2005
INVENTOR(S) : Richard W. Webster and John T. Mann It is certified that error appears in the above-identified patent and that said Letters Patent is hereby corrected as shown below:

Title page,
Item [57], ABSTRACT,
Line 6, "A top" should read -- Atop --.

Column 2,
Line 27, there should be a period "." after the first appearance of the words "tension shelf"

Column 4,
Line 19, "aberrations the stretch" should read -- aberrations in the stretch --.

Column 6,
Line 13, "plurality superposed defined sections" should read -- plurality of superposed defined sections --.

Signed and Sealed this

Fourteenth Day of June, 2005

JON W. DUDAS
*Director of the United States Patent and Trademark Office*